US012768602B2

(12) United States Patent
Hwang et al.

(10) Patent No.: US 12,768,602 B2
(45) Date of Patent: Oct. 20, 2026

(54) MANIFOLD REFRIGERANT MODULE

(71) Applicant: Hanon Systems, Daejeon (KR)

(72) Inventors: In Guk Hwang, Daejeon (KR); Sang Yong Rhee, Daejeon (KR); Sung Je Lee, Daejeon (KR); Hae Jun Lee, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 86 days.

(21) Appl. No.: 18/715,620

(22) PCT Filed: Jan. 5, 2023

(86) PCT No.: PCT/KR2023/000233
§ 371 (c)(1),
(2) Date: May 31, 2024

(87) PCT Pub. No.: WO2023/132659
PCT Pub. Date: Jul. 13, 2023

(65) Prior Publication Data

US 2025/0020419 A1 Jan. 16, 2025

(30) Foreign Application Priority Data

Jan. 10, 2022 (KR) ..... 10-2022-0003405

(51) Int. Cl.

| | |
|---|---|
| ***F28F 9/02*** | (2006.01) |
| ***F25B 39/00*** | (2006.01) |
| ***F25B 39/02*** | (2006.01) |
| ***F25B 39/04*** | (2006.01) |
| ***F25B 41/325*** | (2021.01) |

(52) U.S. Cl.
CPC ..... *F28F 9/0202* (2013.01); *F25B 39/00* (2013.01); *F25B 41/325* (2021.01); *F25B 39/022* (2013.01); *F25B 39/04* (2013.01); *F25B 2339/047* (2013.01)

(58) Field of Classification Search
CPC .... F28F 9/0202; F25B 39/022; B60H 1/3229; F28D 1/05325
USPC ..... 62/506
See application file for complete search history.

(56) References Cited

U.S. PATENT DOCUMENTS

2019/0039440 A1 2/2019 Calderone
2019/0047373 A1* 2/2019 Kim ..... B60H 1/00342

FOREIGN PATENT DOCUMENTS

| | | | |
|---|---|---|---|
| CN | 113276630 | A | 8/2021 |
| JP | 2017172948 | A | 9/2017 |
| KR | 10-2019-0002878 | A | 1/2019 |
| KR | 10-2019-0016711 | | 2/2019 |
| KR | 10-2021-0136642 | A | 11/2021 |

OTHER PUBLICATIONS

English Translation of Official Action issued Mar. 30, 2026 in related Korean Patent Application No. 10-2022-0003405, 9 pgs.

* cited by examiner

*Primary Examiner* — Steve S Tanenbaum
(74) *Attorney, Agent, or Firm* — NORTON ROSE FULBRIGHT US LLP

(57) ABSTRACT

The present invention provides a manifold refrigerant module comprising: a manifold plate having a plurality of refrigerant flow paths formed therein; and a plurality of heat exchangers arranged on the manifold plate, wherein the plurality of heat exchangers are arranged in the left-right direction or the up-down direction.

14 Claims, 8 Drawing Sheets

[FIG. 1]
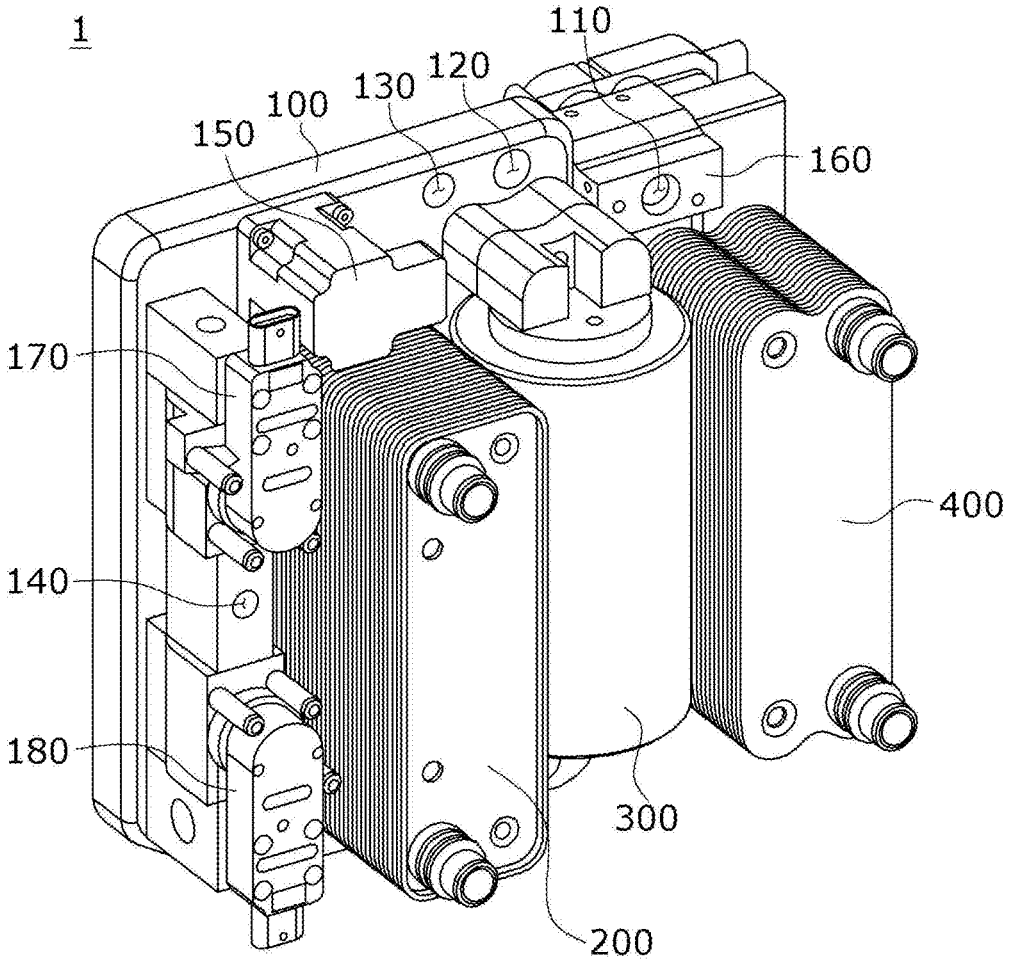

[FIG. 2]
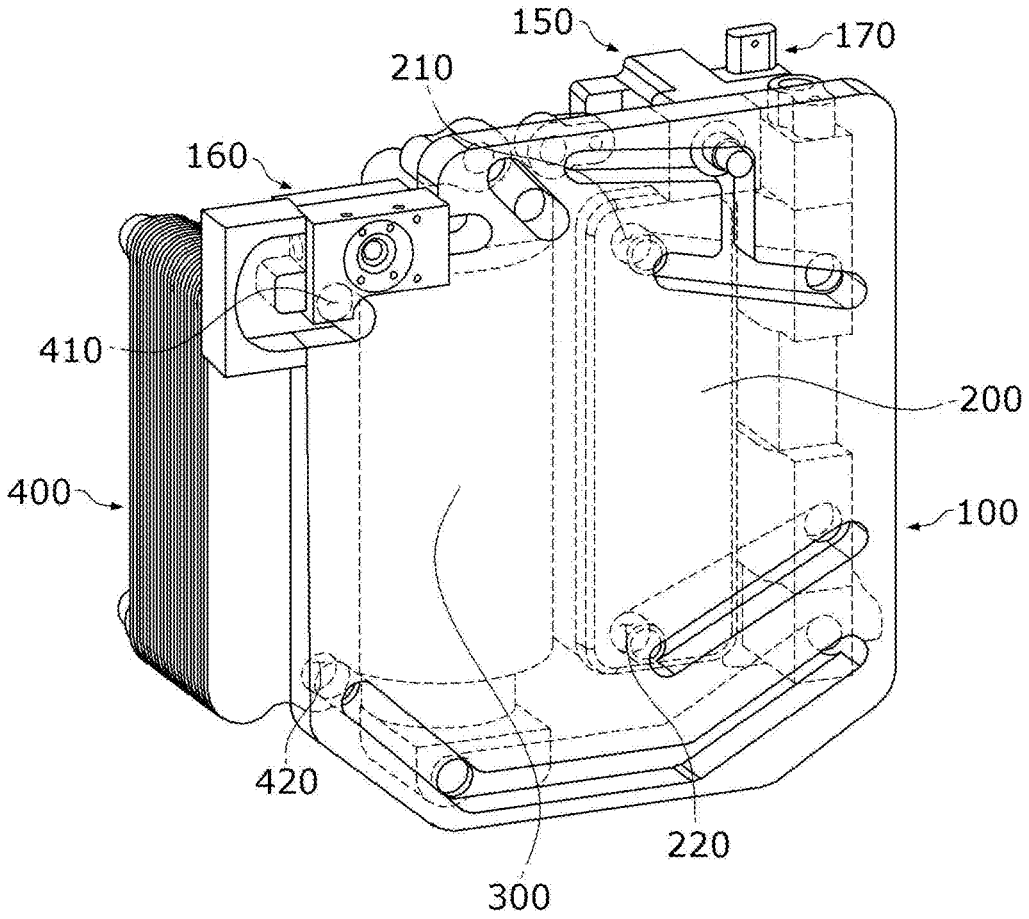

[FIG. 3]
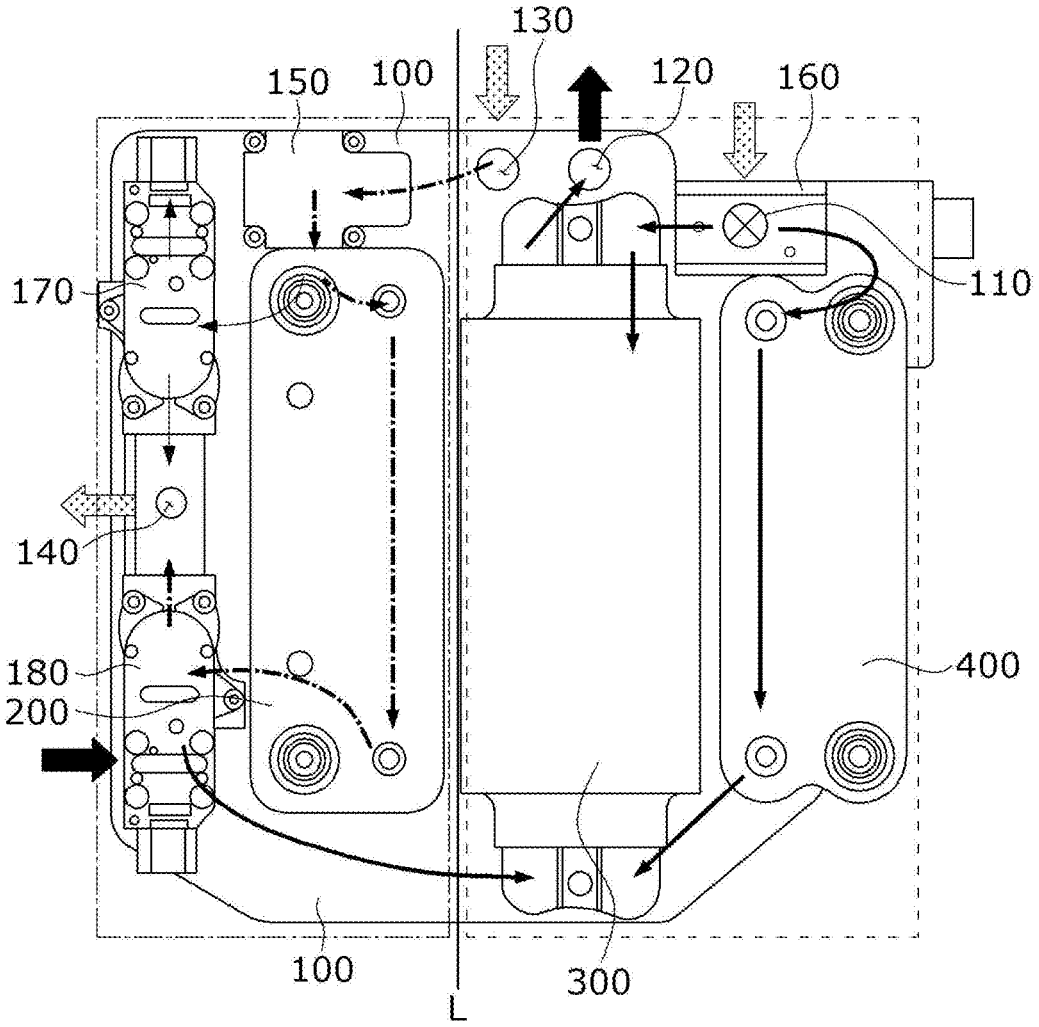

[FIG. 4]
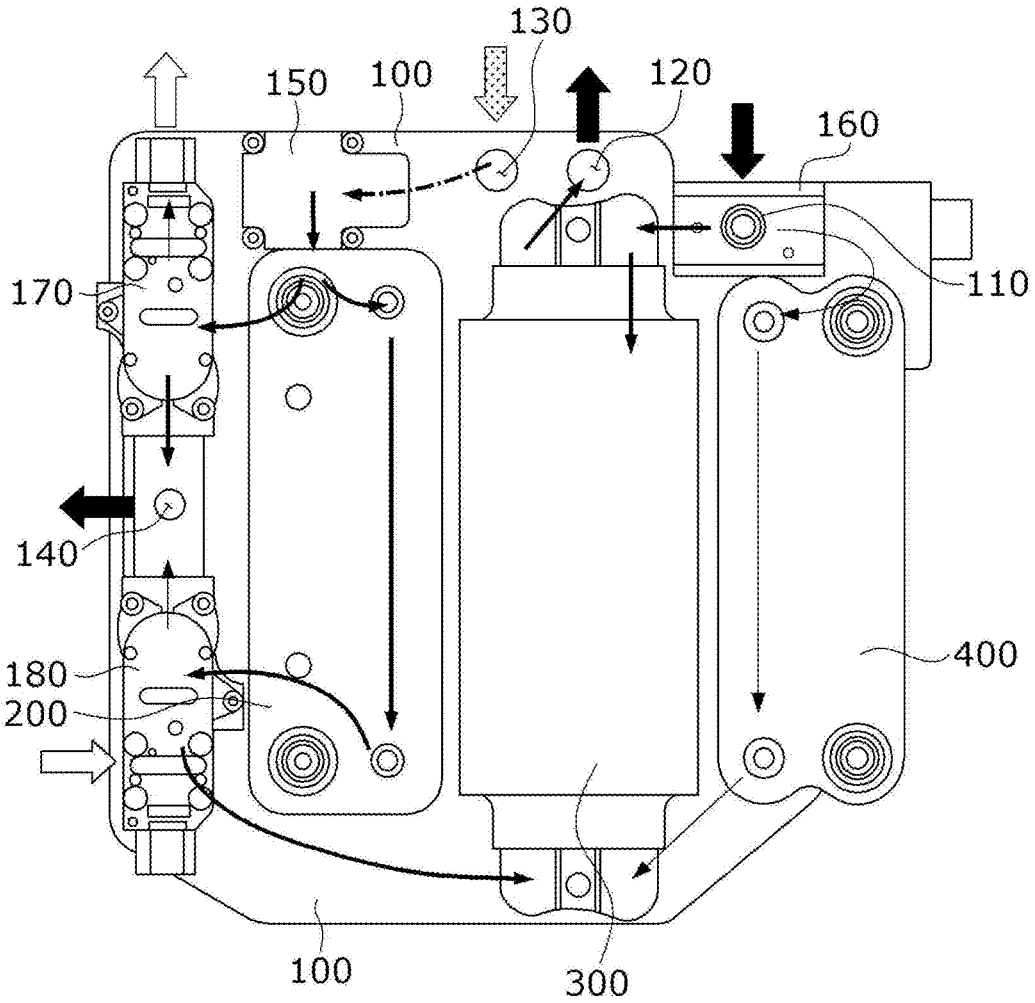

[FIG. 5]
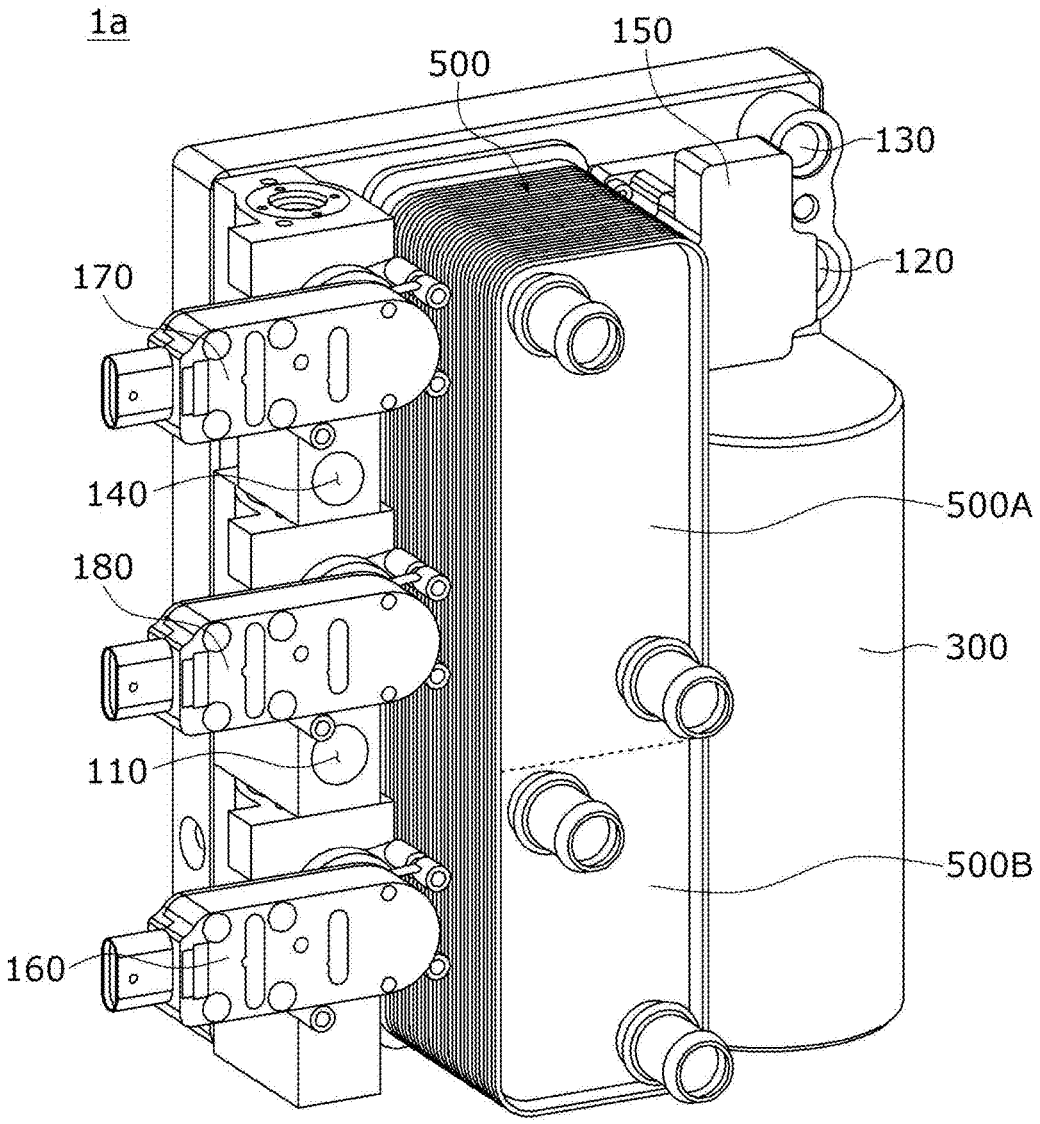

[FIG. 6]
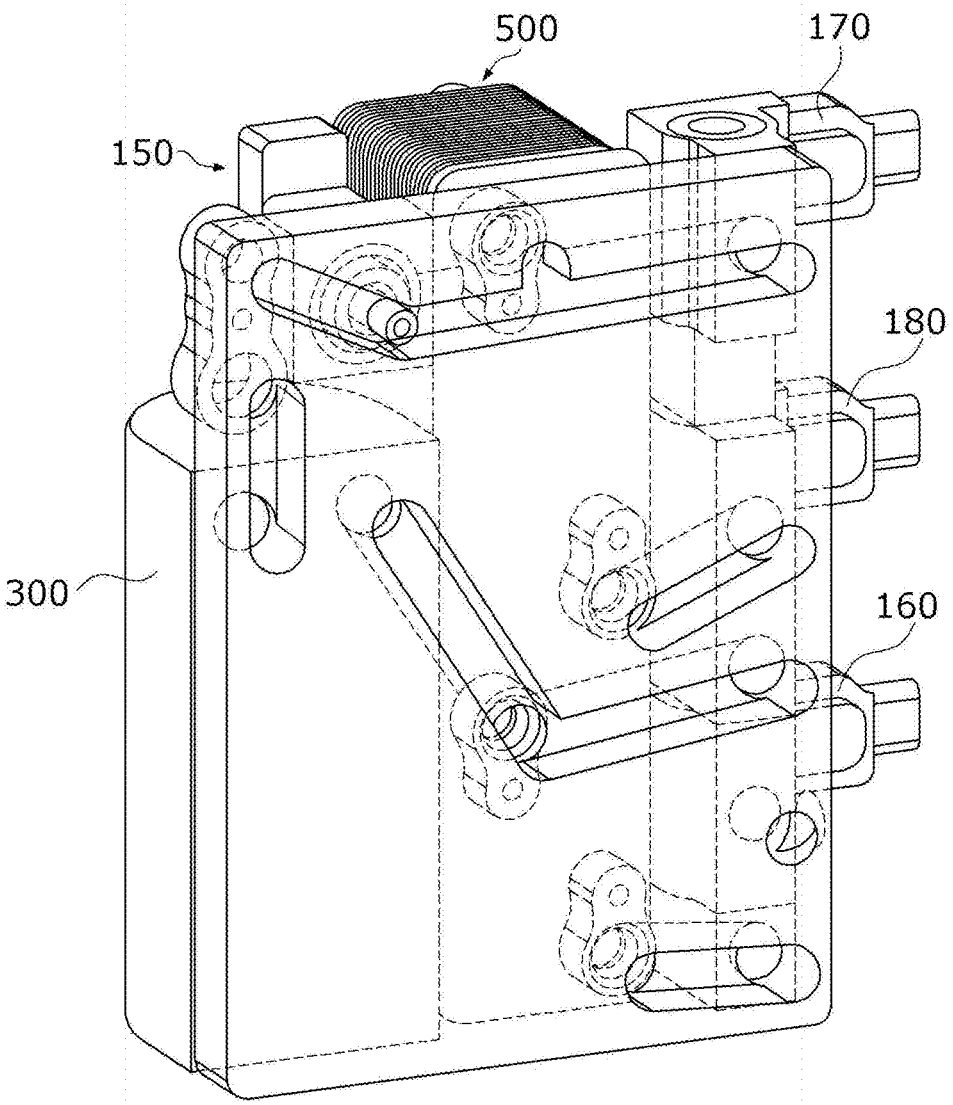

[FIG. 7]
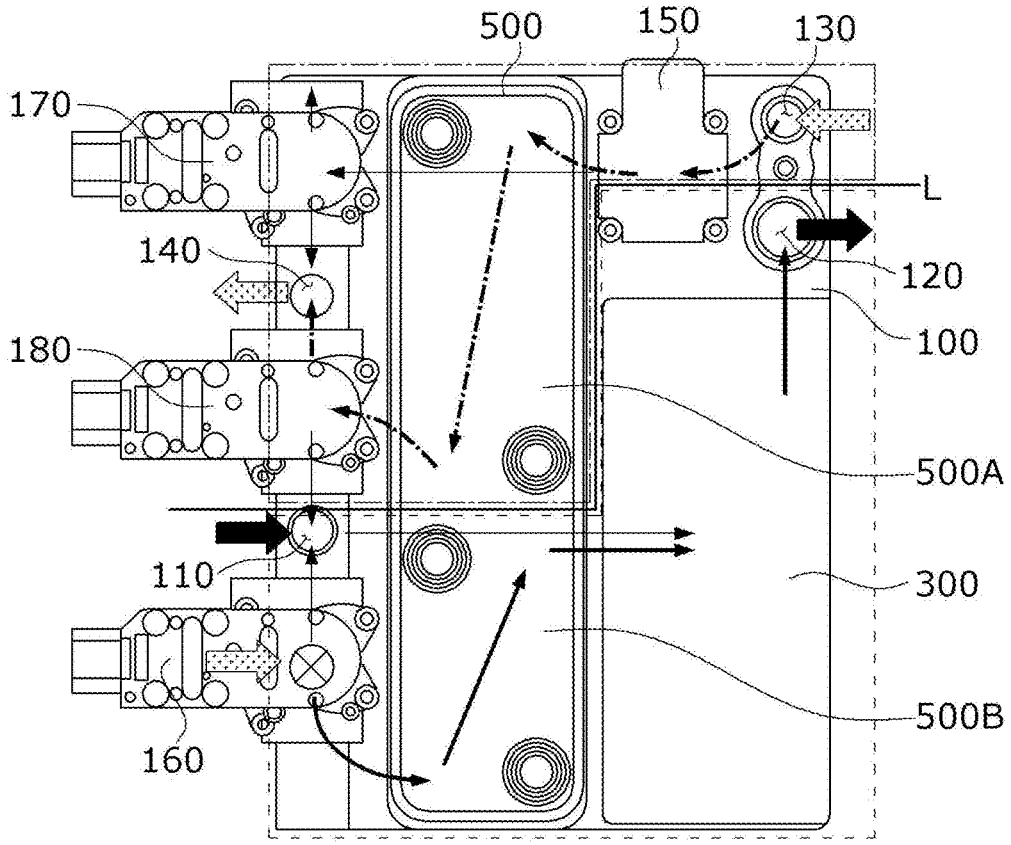

[FIG. 8]
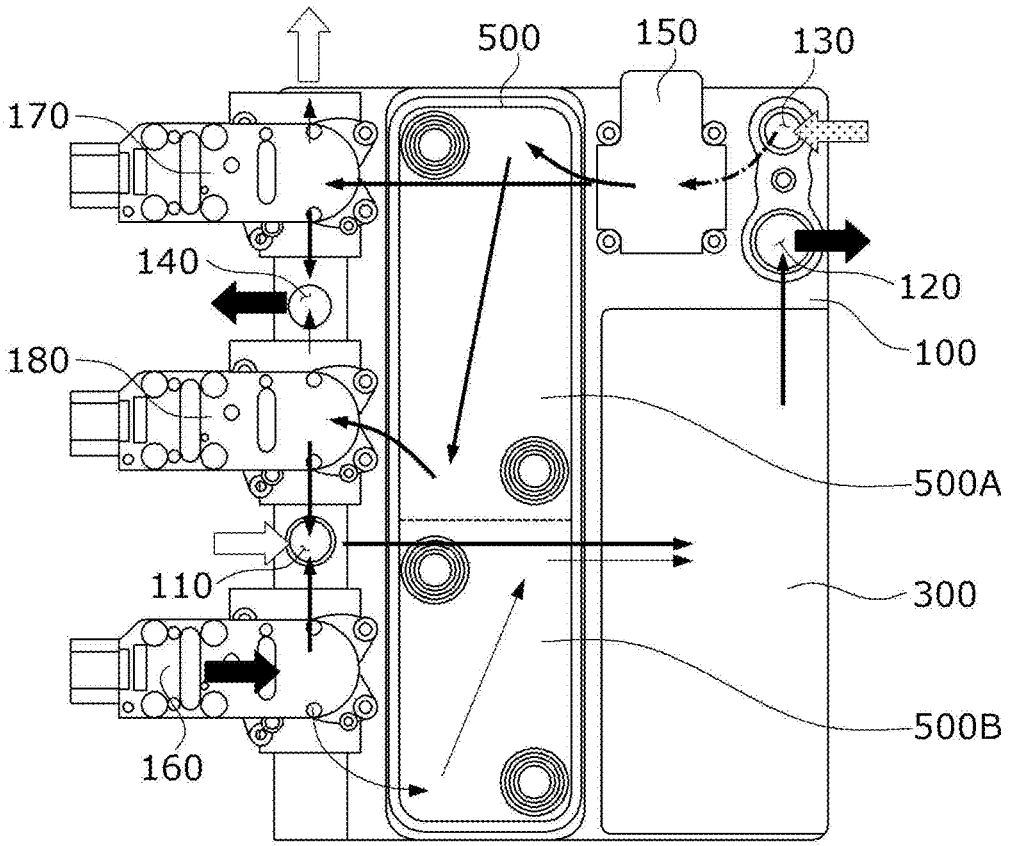

MANIFOLD REFRIGERANT MODULE

CROSS REFERENCE TO RELATED APPLICATIONS

This application is a national phase under 35 U.S.C. § 371 of International Application No. PCT/KR2023/000233 filed on Jan. 5, 2023, which claims the benefit of priority from Korean Patent Application No. 10-2022-0003405 filed on Jan. 10, 2022. The entire contents of these applications are incorporated herein by reference in their entirety.

TECHNICAL FIELD

An embodiment relates to a manifold refrigerant module, and more particularly, to a manifold refrigerant module in which pipes, fittings, and pod parts are formed into one block.

BACKGROUND ART

Under the trend of the environmentally friendly industrial development and the development of energy sources that replace fossil fuel, fields that are recently spotlighted in a vehicle industry include electric vehicles and hybrid vehicles. These electrical vehicles and hybrid vehicles are equipped with batteries that provide power, and the batteries are used not only for driving but also for cooling and heating.

In vehicles that provide driving forces using the batteries, the fact that the batteries are used as heat sources during the cooling and heating means that a drivable distance is decreased due to the fact. A method of applying a heat pump system, which is widely used as a household cooling and heating device, to the vehicles from the related art has been proposed in order to overcome the above problem.

For reference, a heat pump is a device that absorbs low-temperature heat and moves the absorbed heat to a high temperature. As an example, the heat pump has a cycle in which a liquefied refrigerant is evaporated in an evaporator, takes heat from the surroundings, and is gasified, and then the gasified refrigerant is liquefied while emitting heat to the surroundings through a condenser. When the heat pump system is applied to the electric vehicles or the hybrid vehicles, a heat source that is insufficient in a general air conditioning case according to the related art may be secured.

In a current modular configuration of the heat pump system for an electric vehicle, important components (valves, accumulators, chillers, condensers, internal heat exchangers, sensors, and the like) are connected by pipes in a partial modularization manner, fittings and connectors are separately formed to connect the pipes, and an appropriate gap for connection between the components is formed. Accordingly, the heat pump system is disadvantageous in terms of packaging, production costs, and workability.

Further, due to imperfections in modularization and integration, performance of the system is degraded due to an unnecessary increase in a movable distance when a current mode is switched between a cooling mode and a heating mode.

DISCLOSURE

Technical Problem

The present invention is directed to providing a manifold refrigerant module of which production costs are reduced, a weight is reduced, and workability is increased using a manifold plate that performs functions of pipes, fittings, and a housing.

The aspects of the present invention are not limited to the aspects described above, and those skilled in the art will clearly understand other aspects not described herein from the following description.

Technical Solution

One aspect of the present invention provides a manifold refrigerant module including a manifold plate in which a plurality of refrigerant flow paths are formed and a plurality of heat exchangers arranged on the manifold plate, wherein the plurality of heat exchangers are arranged in a left-right direction or a vertical direction.

The plurality of heat exchangers may include a water-cooled condenser and a chiller, and an accumulator may be disposed between the water-cooled condenser and the chiller.

The chiller and the accumulator may be disposed on one side of a virtual reference line formed on the manifold plate, and the water-cooled condenser may be disposed on the other side.

A first expansion valve that controls whether a refrigerant introduced into the water-cooled condenser expands and a first direction changing valve and a second direction changing valve that control a direction of a refrigerant discharged from the water-cooled condenser may be disposed on the other side of the reference line.

When the refrigerant module is in an air conditioner mode, a high-pressure refrigerant introduced into the manifold plate from the outside may circulate through and is discharged from the other side of the reference line.

At least one of the plurality of heat exchangers may be a water-cooled integrated heat exchanger, an accumulator may be disposed on the manifold plate, and an interior of the water-cooled integrated heat exchanger may be partitioned into an upper water-cooled condenser area and a lower chiller area, and the chiller area and the accumulator may be arranged adjacent to each other.

A refrigerant introduced into the water-cooled condenser area may flow from above and move to below, and a refrigerant introduced into the chiller area may flow from below and move to above.

The refrigerant introduced into the accumulator may move in close proximity to a portion partitioned into the water-cooled condenser area and the chiller area.

When the refrigerant module is in an air conditioner mode, a refrigerant moved through the manifold plate may be separated into a high-pressure area and a low-pressure area through a reference line.

A first expansion valve that controls whether the refrigerant introduced into the water-cooled condenser area expands and a first direction changing valve and a second direction changing valve configured to control a direction of the refrigerant discharged from the water-cooled condenser area may be disposed on an upper side of the reference line.

The chiller area may be disposed between the second expansion valve and the accumulator.

Advantageous Effects

According to an embodiment, production costs and a weight of a refrigerant module can be reduced.

Further, in an embodiment, workability of the refrigerant module can be increased, and packaging workability can be maximized.

Various and beneficial advantages and effects of the present invention are not limited to the above description and will be more easily understood in a process of describing specific embodiments of the present invention.

DESCRIPTION OF DRAWINGS

FIG. 1 is a perspective view of a manifold refrigerant module according to an embodiment of the present invention.

FIG. 2 is a rear perspective view of the manifold refrigerant module according to the embodiment of the present invention.

FIG. 3 is a view illustrating flow of a refrigerant in an air conditioner mode in FIG. 1.

FIG. 4 is a view illustrating the flow of the refrigerant in a heat pump mode in FIG. 1.

FIG. 5 is a perspective view of a manifold refrigerant module according to another embodiment of the present invention.

FIG. 6 is a rear perspective view of the manifold refrigerant module according to another embodiment of the present invention.

FIG. 7 is a view illustrating flow of a refrigerant in an air conditioner mode in FIG. 5.

FIG. 8 is a view illustrating the flow of the refrigerant in a heat pump mode in FIG. 5.

MODES OF THE INVENTION

Hereinafter, embodiments of the present invention will be described in detail with reference to the accompanying drawings.

However, the technical spirit of the present invention is not limited to some embodiments to be described and may be implemented in various different forms, and one or more components may be selectively combined or substituted between the embodiments within the scope of the technical spirit of the present invention.

Further, unless explicitly defined and described, terms (including technical and scientific terms) used in the embodiments of the present invention may be interpreted in a meaning that may be generally understood by those skilled in the art to which the present invention pertains. Terms generally used, such as terms defined in the dictionary, may be interpreted in consideration of the meaning of the context of the related technology.

Further, terms used in the embodiments of the present invention are for describing the embodiments and are not intended to limit the present invention.

In the present specification, a singular form may include a plural form unless specifically mentioned in a phrase, and when "at least one (or one or more) of A, B, and C" is described, one or more of all combinations that may be combined with A, B, and C may be included.

Further, in the description of the components of the embodiments of the present invention, terms such as first, second, A, B, (a) and (b) may be used.

These terms are not used to delimit an essence, an order or sequence, and the like of a corresponding component but used merely to distinguish the corresponding component from other component(s).

Further, when it is described that a first component is "connected" or "coupled" to a second component, the first component may be "connected" or "coupled" to the second component with a third component therebetween as well as the first component may be directly connected or coupled to the second component.

Further, when it is described that a first component is formed or disposed "above" or "below" a second component, the terms "above" and "below" include that one or more third components may be formed or arranged between the first and second components as well as the first and second components may be in direct contact with each other. Further, when the "above or below" is expressed, the "above or below" may include the meanings of a downward direction as well as an upward direction based on one component.

Hereinafter, embodiments will be described in detail with reference to the accompanying drawings, the same or corresponding components are designated by the same reference numerals regardless of the reference numerals, and the duplicated description thereof will be omitted.

FIGS. 1 to 6 clearly illustrate only main feature parts in order to conceptually and clearly understand the present invention, and as a result, various modifications of the illustration are expected, and the scope of the present invention is not necessarily limited by specific shapes illustrated in the drawings.

FIG. 1 is a perspective view of a manifold refrigerant module according to an embodiment of the present invention, FIG. 2 is a rear perspective view of the manifold refrigerant module according to the embodiment of the present invention, FIG. 3 is a view illustrating flow of a refrigerant in an air conditioner mode in FIG. 1, and FIG. 4 is a view illustrating the flow of the refrigerant in a heat pump mode in FIG. 1.

Referring to FIGS. 1 to 4, the manifold refrigerant module 1 according to the embodiment of the present invention includes a manifold plate 100 in which a plurality of refrigerant flow paths are formed, a water-cooled condenser 200 disposed on the manifold plate 100, an accumulator 300, and a chiller 400, and the accumulator 300 is disposed between the chiller 400 and the water-cooled condenser 200.

The plurality of refrigerant flow paths may be formed in the manifold plate 100, and a plurality of components of the heat pump system may be seated on the manifold plate 100. In an embodiment, a plurality valves that controls a direction and expansion of the refrigerant moving through the water-cooled condenser 200, the accumulator 300, and the chiller 400 may be disposed on the manifold plate 100.

The manifold plate 100 may simultaneously serve as functions of pipes, fittings, and a housing, thereby reducing production costs and increasing workability. Further, a plurality of flow paths connected to the water-cooled condenser 200, the accumulator 300, and the chiller 400 may be disposed inside the manifold plate 100.

The water-cooled condenser 200 may exchange heat between a high-temperature high-pressure gaseous refrigerant discharged from a compressor and an internal condenser and an external heat source, condense into a high-pressure liquid, and move the high-pressure liquid. Further, the water-cooled condenser 200 may include an inlet 210 in which a refrigerant is introduced and an outlet 220 from which a refrigerant is discharged. In this case, in consideration of thermal interference, the inlet 210 may be disposed on one side of the water-cooled condenser 200, which is close to a first expansion valve 150, and the outlet 220 may be disposed on the other side of the water-cooled condenser 200, which is far from the first expansion valve 150. In detail, the inlet 210 may be disposed closer to the first expansion valve 150 than the outlet 220. For example, a distance from the first expansion valve 150 to the inlet 210 may be smaller than a distance from the first expansion valve 150 to the outlet 220. Here, the inlet 210 may be called a water-cooled condenser inlet or a first inlet, and the outlet may be called a water-cooled condenser outlet or a first outlet.

The accumulator 300 may be installed on an inlet side of the compressor (not illustrated), a refrigerant passing through the evaporator and/or the chiller 400 may be joined in the accumulator 300, and the accumulator 300 may separate a liquefied refrigerant and a gaseous refrigerant among the refrigerants and provide only the gaseous refrigerant to the compressor.

In the chiller 400, a low-temperature low-pressure refrigerant is supplied, and heat is exchanged between the low-temperature low-pressure refrigerant and a coolant moving in a coolant circulation line (not illustrated). The cold coolant heat-exchanged by the chiller 400 may exchange heat with the battery while circulating through the coolant circulation line. Further, the chiller 400 may include an inlet 410 in which a refrigerant is introduced and an outlet 420 from which a refrigerant is discharged. In this case, in consideration of thermal interference, the inlet 410 may be disposed on one side of the chiller 400, which is close to a second expansion valve 160, and the outlet 420 may be disposed on the other side of the chiller 400, which is far from the second expansion valve 160. In detail, the inlet 410 may be disposed closer to the second expansion valve 160 than the outlet 420. For example, a distance from the second expansion valve 160 to the inlet 410 may be smaller than a distance from the second expansion valve 160 to the outlet 420. Here, the inlet 410 may be called a chiller inlet or a second inlet, and the outlet may be called a chiller outlet or a second outlet.

According to an embodiment of the present invention, the chiller 400 and the accumulator 300 may be disposed on one side of a reference line L formed in the manifold plate 100, and the water-cooled condenser 200 may be disposed on the other side of the reference line L.

Further, the first expansion valve 150 that controls whether the refrigerant introduced into the water-cooled condenser 200 expands and a first direction changing valve 170 and a second direction changing valve 180 that control a direction of the refrigerant discharged from the water-cooled condenser 200 may be disposed on the other side of the reference line L.

The first expansion valve 150 may be disposed on an upper side of the water-cooled condenser 200 and may expand or transmit the refrigerant introduced through a second inlet hole 130 formed in the manifold plate 100. The refrigerant introduced through the first expansion valve 150 may be heat-exchanged or moved to an external heat exchanger while passing through a water-cooled condensing port.

In this case, the refrigerant moved through the water-cooled condenser 200 may be moved to the evaporator or the external heat exchanger through the first direction changing valve 170 disposed on an upper side of a lateral surface of the water-cooled condenser 200, and a movement direction of the refrigerant passing through the water-cooled condenser 200 may be controlled through the second direction changing valve 180.

The second expansion valve 160, which is disposed on one side of the reference line L, is disposed on an upper side of the chiller 400, and the refrigerant flows into the second expansion valve 160 through the first inlet hole 110. The second expansion valve 160 may expand and move the refrigerant introduced through the first inlet hole 110.

A component through which a low-pressure refrigerant moves may be disposed at one side of the reference line L. The accumulator 300 and chiller 400 may be connected in parallel and arranged such that the refrigerant is moved therethrough. In this structure, the chiller 400 may be disposed at the farthest position from the water-cooled condenser 200, thereby minimizing thermal interference between refrigerants.

Referring to FIG. 3, in the air conditioner mode, the high-pressure refrigerant introduced into the manifold plate 100 from the outside may circulate through and flow out through the other side of the reference line L.

The high-pressure refrigerant introduced through the second inlet hole 130 formed in the manifold plate 100 flows into the first expansion valve 150, and the refrigerant passes through the first expansion valve 150 in an open state and flows into the water-cooled condenser 200. The refrigerant passing through the water-cooled condenser 200 is introduced into the second direction changing valve 180 and discharged to the external heat exchanger.

The refrigerant introduced through the first inlet hole 110 is heat-exchanged while passing through the chiller 400 and then is moved to the accumulator 300, and the refrigerant introduced from the evaporator through the second direction changing valve 180 flows into the accumulator 300.

The refrigerant introduced into the accumulator 300 is separated into a gaseous refrigerant and a liquefied refrigerant, and the gaseous refrigerant is introduced into the compressor through the first outlet hole 120 and circulates.

In this way, in the air conditioner mode, the high-pressure refrigerant introduced into the manifold plate 100 may circulate through the other side of the reference line L, thereby minimizing thermal interference between refrigerants and optimizing a refrigerant flow.

Referring to FIG. 4, in the heat pump mode, the refrigerant introduced through the second inlet hole 130 expands while passing through the first expansion valve 150 and then flows into the water-cooled condenser 200, and the refrigerant passing through the water-cooled condenser 200 passes through the first direction changing valve 170 and/or the second direction changing valve 180, moves to the external heat exchanger, and is discharged to the outside of the manifold plate 100 through the second outlet hole 140.

The refrigerant introduced into the second expansion valve 160 through the first inlet hole 110 moves to the accumulator 300 as the accumulator 300 is opened. Further, the refrigerant introduced into the second direction changing valve 180 and moved through the evaporator flows into the accumulator 300, the refrigerant introduced into the accumulator 300 is separated into the gaseous refrigerant and the liquefied refrigerant, the gaseous refrigerant flows into the compressor, and then the refrigerant circulates through the heat pump system.

Meanwhile, a manifold refrigerant module according to another embodiment of the present invention will be described below with reference to the accompanying drawings. However, a description that is the same as that described in the manifold refrigerant module according to the embodiment of the present invention will be omitted.

FIG. 5 is a perspective view of a manifold refrigerant module according to another embodiment of the present invention, FIG. 6 is a rear perspective view of the manifold refrigerant module according to another embodiment of the present invention, FIG. 7 is a view illustrating flow of a refrigerant in an air conditioner mode in FIG. 5, and FIG. 8 is a view illustrating the flow of the refrigerant in a heat pump mode in FIG. 5.

In description of FIGS. 5 to 8, the same members are designated by the same reference numerals as those of FIGS. 1 to 4, and a detailed description thereof will be omitted.

Referring to FIGS. 5 to 8, a manifold refrigerant module 1*a* according to another embodiment of the present invention includes the manifold plate 100 in which a plurality of refrigerant flow paths are formed, a water-cooled integrated heat exchanger 500 disposed on the manifold plate 100, and the accumulator 300. The water-cooled integrated heat exchanger is partitioned into an upper water-cooled condenser area 500A and a lower chiller area 500B, and the chiller area 500B and the accumulator 300 may be disposed adjacent to each other.

The accumulator 300 may be disposed on one side of the water-cooled integrated heat exchanger 500. In this case, the accumulator 300 may be biased toward the chiller area 500B rather than the water-cooled condenser area 500A.

A refrigerant introduced into the water-cooled condenser area 500A may flow from above and move to below, and a refrigerant introduced into the chiller area 500B may flow from below and move to above. This structure can minimize thermal interference between a refrigerant moved at a high temperature and a high pressure and a refrigerant moved at a low temperature and a low pressure.

The first expansion valve 150 that controls whether the refrigerant introduced into the water-cooled condenser area 500A expands and movement of the refrigerant and the first direction changing valve 170 and the second direction changing valve 180 that control a direction of the refrigerant discharged from the water-cooled condenser area 500A may be arranged above the reference line L, and the second expansion valve 160 that controls whether the refrigerant introduced into the chiller area 500B and movement of the refrigerant may be disposed below the reference line L. As illustrated in FIGS. 5 and 6, the first expansion valve 150 may be positioned at a side surface of the water-cooled condenser area 500A. Therefore, in the air conditioner mode, a component through which the high-pressure refrigerant is moved and a component through which a low-pressure refrigerant is moved are separately arranged, and thus thermal interference can be minimized.

In other words, the chiller area 500B may be disposed between the second expansion valve 160 and the accumulator 300, and a component through which a low-pressure refrigerant is moved may be disposed in the same area below the reference line L. As illustrated in FIGS. 5 and 6, the second expansion valve 160 may be positioned at a side surface of the chiller area 500B.

Further, the first expansion valve 150 in which the high-pressure refrigerant is introduced from the second inlet hole 130 may be spaced apart from the accumulator 300. The manifold plate 100 has a limited space, but even in the limited area, the first expansion valve 150 and the accumulator 300 may be spaced apart from each other, thereby minimizing thermal interference between refrigerants.

Referring to FIG. 7, in the case of the air conditioner mode, the refrigerant introduced from the compressor or the internal condenser through the second inlet hole 130 passes through the first expansion valve 150 in an open state, flows into an upper portion of the water-cooled condenser area 500A and then move to a lower portion thereof. The refrigerant passing through the water-cooled condenser area 500A moves to the external heat exchanger via the second direction changing valve 180. In this case, the first direction changing valve 170 is closed, and thus the refrigerant is not introduced.

The refrigerant introduced into the second expansion valve 160 through the first inlet hole 110 is introduced into a lower portion of the chiller area 500B, is heat-exchanged with the coolant, and then moves to the accumulator 300. In this case, the refrigerant moved to the accumulator 300 may move in close proximity to an area in which the water-cooled integrated heat exchanger 500 is partitioned into the water-cooled condenser area 500A and the chiller area 500B. This is to minimize thermal interference between the refrigerant moved to the accumulator 300 and the refrigerant moved through the water-cooled heat exchanger area 500A and the chiller area 500B.

Among the refrigerant separated into the gaseous refrigerant and the liquefied refrigerant in the accumulator 300, the gaseous refrigerant may be moved to the first outlet hole 120 and flow into the compressor.

Referring to FIG. 8, in the case of the heat pump mode, the refrigerant introduced through the second inlet hole 130 may expands while passing through the first expansion valve 150 and may flow into the water-cooled condenser area 500A of the water-cooled integrated heat exchanger 500 and/or the first direction changing valve 170.

The refrigerant introduced into the first direction changing valve 170 may be introduced into the external heat exchanger through the second outlet hole 140, and the refrigerant introduced into the water-cooled condenser area 500A passes through the water-cooled condenser area 500A, flows into the second direction changing valve 180, and then flows into the accumulator 300.

Further, the refrigerant introduced into the second expansion valve 160 from the external heat exchanger is moved to the accumulator 300.

The refrigerant moved to the accumulator 300 is separated into the gaseous refrigerant and the liquefied refrigerant, the gaseous refrigerant flows into the compressor through the first outlet hoe 120, and the refrigerant circulates.

As described above, embodiments of the present invention have been described in detail with reference to the accompanying drawings.

The above description is merely illustrative of the technical spirit of the present invention, and those skilled in the art to which the present invention belongs may make various modifications, changes, and substitutes without departing from the essential features of the present invention. Thus, the embodiments disclosed in the present invention and the accompanying drawings are not intended to limit the technology spirit of the present invention, but are intended to describe the present invention, and the scope of the technical spirit of the present invention is not limited by these embodiments and the accompanying drawings. The scope of protection of the present invention should be interpreted by the appended claims, and all technical spirits within the scope equivalent thereto should be interpreted as being included in the scope of the present invention.

DESCRIPTION OF REFERENCE NUMERALS

1, 1*a*: Manifold refrigerant module
100: Manifold plate
110: First inlet hole
120: First outlet hole
130: Second inlet hole
140: Second outlet hole
150: First expansion valve

160: Second expansion valve
170: First direction changing valve
180: Second direction changing valve
200: Water-cooled condenser
300: Accumulator
400: Chiller
500: Water-cooled integrated heat exchanger
500A: Water-cooled condenser area
500B: Chiller area
L: Reference line

The invention claimed is:

1. A manifold refrigerant module comprising:
a manifold plate in which a plurality of refrigerant flow paths are formed; and
a plurality of heat exchangers arranged on the manifold plate,
wherein the plurality of heat exchangers are arranged in a left-right direction or a vertical direction,
wherein the plurality of heat exchangers include a water-cooled condenser and a chiller, and an accumulator is disposed between the water-cooled condenser and the chiller,
wherein the chiller and the accumulator are disposed at one side of a virtual reference line formed on the manifold plate, and the water-cooled condenser is disposed on the other side of the reference line, and
wherein a first expansion valve configured to control whether a refrigerant introduced into the water-cooled condenser expands and a first direction changing valve and a second direction changing valve configured to control a direction of a refrigerant discharged from the water-cooled condenser are disposed on the other side of the reference line.

2. A manifold refrigerant module comprising:
a manifold plate in which a plurality of refrigerant flow paths are formed;
a plurality of heat exchangers arranged on the manifold plate; and
a first expansion valve configured to expand a refrigerant introduced into the water-cooled condenser and a second expansion valve configured to expand a refrigerant introduced into the chiller, wherein the first expansion valve is positioned at an upper side of the water-cooled condenser, and the second expansion valve is positioned at an upper side of the chiller,
wherein the plurality of heat exchangers are arranged in a left-right direction or a vertical direction, and
wherein the plurality of heat exchangers include a water-cooled condenser and a chiller, and an accumulator is disposed between the water-cooled condenser and the chiller.

3. The manifold refrigerant module of claim 2, wherein an inlet of the water-cooled condenser is disposed on a first side of the water-cooled condenser adjacent to the first expansion valve, and an outlet of the water-cooled condenser is disposed on a second side of the water-cooled condenser opposite to the first side.

4. The manifold refrigerant module of claim 2, wherein an inlet of the chiller is disposed on a first side of the chiller adjacent to the second expansion valve, and an outlet of the chiller is disposed on a second side of the chiller opposite to the first side.

5. A manifold refrigerant module comprising:
a manifold plate in which a plurality of refrigerant flow paths are formed; and
a plurality of heat exchangers arranged on the manifold plate,
wherein the plurality of heat exchangers are arranged in a left-right direction or a vertical direction,
wherein the plurality of heat exchangers include a water-cooled condenser and a chiller, and
wherein an accumulator is positioned between the water-cooled condenser and the chiller along a linear axis that extends through the water-cooled condenser, the accumulator, and the chiller.

6. The manifold refrigerant module of claim 5, wherein the chiller and the accumulator are disposed at one side of a virtual reference line formed on the manifold plate, and the water-cooled condenser is disposed on the other side of the reference line.

7. The manifold refrigerant module of claim 6, wherein, when the refrigerant module is in an air conditioner mode, a high-pressure refrigerant introduced into the manifold plate from the outside circulates through and is discharged from the other side of the reference line.

8. The manifold refrigerant module of claim 5, wherein at least one of the plurality of heat exchangers is a water-cooled integrated heat exchanger, an accumulator is disposed on the manifold plate, an interior of the water-cooled integrated heat exchanger is partitioned into an upper water-cooled condenser area and a lower chiller area, and the chiller area and the accumulator are arranged adjacent to each other.

9. The manifold refrigerant module of claim 8, comprising a first expansion valve configured to expand a refrigerant introduced into the water-cooled condenser area and a second expansion valve configured to a refrigerant introduced into the chiller area, wherein the first expansion valve is positioned at a side surface of the water-cooled condenser area, and the second expansion valve is positioned at a side surface of the chiller area.

10. The manifold refrigerant module of claim 8, wherein a refrigerant introduced into the water-cooled condenser area flows from above and moves to below, and a refrigerant introduced into the chiller area flows from below and moves to above.

11. The manifold refrigerant module of claim 10, wherein the refrigerant introduced into the accumulator moves in close proximity to a portion partitioned into the water-cooled condenser area and the chiller area.

12. The manifold refrigerant module of claim 8, wherein, when the refrigerant module is in an air conditioner mode, a refrigerant moved through the manifold plate is separated into a high-pressure area and a low-pressure area through a reference line.

13. The manifold refrigerant module of claim 12, wherein a first expansion valve configured to control whether the refrigerant introduced into the water-cooled condenser area expands and a first direction changing valve and a second direction changing valve configured to control a direction of the refrigerant discharged from the water-cooled condenser area are disposed on an upper side of the reference line.

14. The manifold refrigerant module of claim 13, wherein the chiller area is disposed between the second expansion valve and the accumulator.

* * * * *